US005425485A

United States Patent [19]

Carlo

[11] Patent Number: 5,425,485

[45] Date of Patent: Jun. 20, 1995

[54] BOOT CONNECTING AND CARRYING STRAP

[76] Inventor: Doug Carlo, 904 Park Cir., Huxley, Iowa 50124

[21] Appl. No.: 304,398

[22] Filed: Sep. 12, 1994

[51] Int. Cl.[6] ..... A45F 3/14

[52] U.S. Cl. ..... 224/258; 224/257; 224/202; 224/205; 224/214; 224/250; 224/917; 24/298

[58] Field of Search ..... 224/257, 258, 202, 205, 224/214, 250, 917; 24/298, 302, 300, 3 M

[56] References Cited

U.S. PATENT DOCUMENTS 609,731 8/1898 Carley ..... 224/205
3,947,927 4/1976 Rosenthal ..... 24/298
4,487,346 12/1984 Fischer, Jr. ..... 224/258
5,246,154 9/1993 Adams et al. ..... 224/257
5,335,835 8/1994 Hogan ..... 224/917
5,370,286 12/1994 Newman ..... 224/257

*Primary Examiner*—Henry J. Recla
*Assistant Examiner*—Charles R. Eloshway
*Attorney, Agent, or Firm*—James C. Nemmers

[57] ABSTRACT

A shoulder strap for carrying and coupling a pair of ski boots. The strap is adjustable in length, and has a cord attached to it that is used to connect the strap to the boots and also to hold the boots together. The strap and cord also use swivel-type connectors that allow the boots to be positioned in the most convenient and comfortable position when being carried by the user.

3 Claims, 2 Drawing Sheets

BOOT CONNECTING AND CARRYING STRAP

BACKGROUND OF THE INVENTION

The popularity of snow skiing has increased in recent years, and technology has provided improved equipment in both skis and ski boots. As a result, an increasing number of skiers have their own ski boots, and even if the boots are rented, they must be carried, along with the skis, to and from the ski slopes or lockers near the slopes. Ski boots are rather large and cumbersome and not easy to carry. Therefore, devices have been developed to connect and couple the boots to facilitate their carrying. Some of the devices can be attached to the body of the user, but they are rather awkward. The other devices that are known are merely boot couplers with a carrying handle, and when the device is removed from the boots, the user must find a place for the carrier which is rather bulky and does not easily fit in the user's pocket, Moreover, some of the couplers are made of rather hard material and if placed in the pocket of the skier might cause injury in the event of a fall.

There is therefore a need for an improved boot coupler and carrier that is easy to use, will free the user's hands for carrying skis and other items, and which can be compactly and easily stored in the user's pocket while skiing.

SUMMARY OF THE INVENTION

The invention provides an adjustable body strap of soft foldable material that will both couple the boots and provide an over-the-shoulder strap to carry the boots and free the hands of the user. The strap fits over the user's shoulder and across the body and has a swivel connector at its end to which is attached the cord that will couple the boots and attach them to the carrying strap by connecting the cord to the swivel connector of the strap. When not in use, the strap can be rolled or folded and placed in the pocket of the user.

DESCRIPTION OF THE PREFERRED EMBODIMENT OF THE INVENTION

Figure 1:
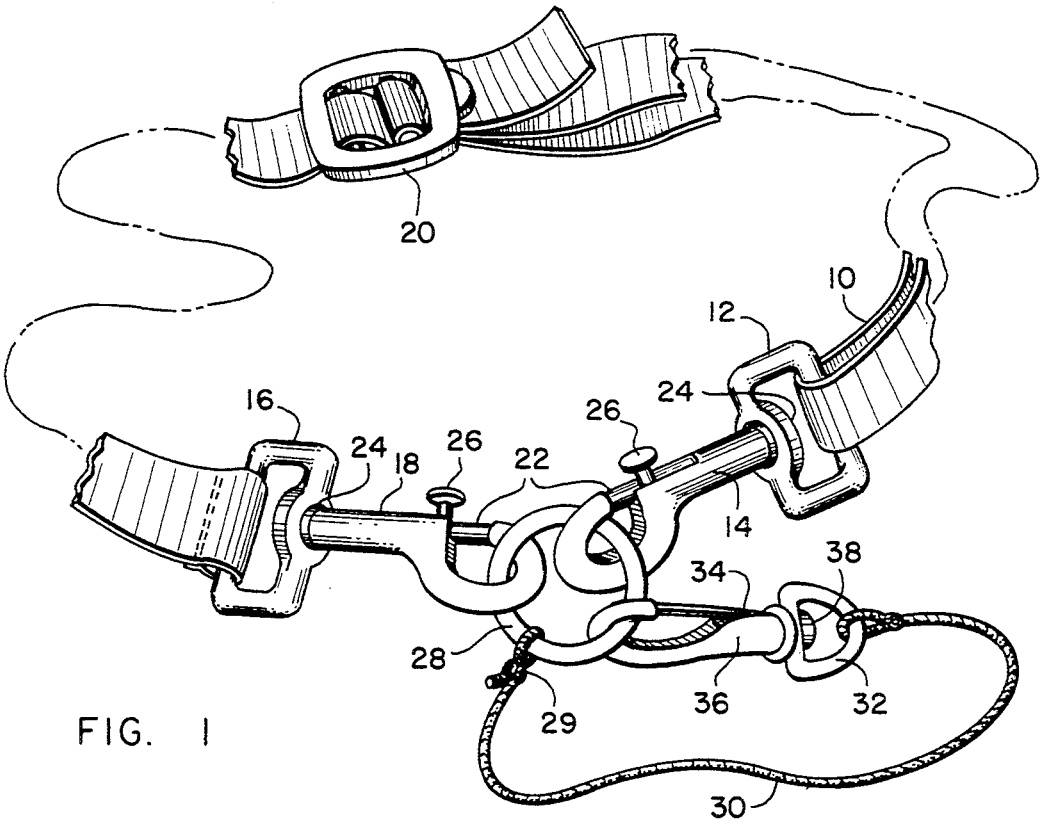
FIG. 1 is a perspective view of the strap and cord of the invention.
Figure 2:
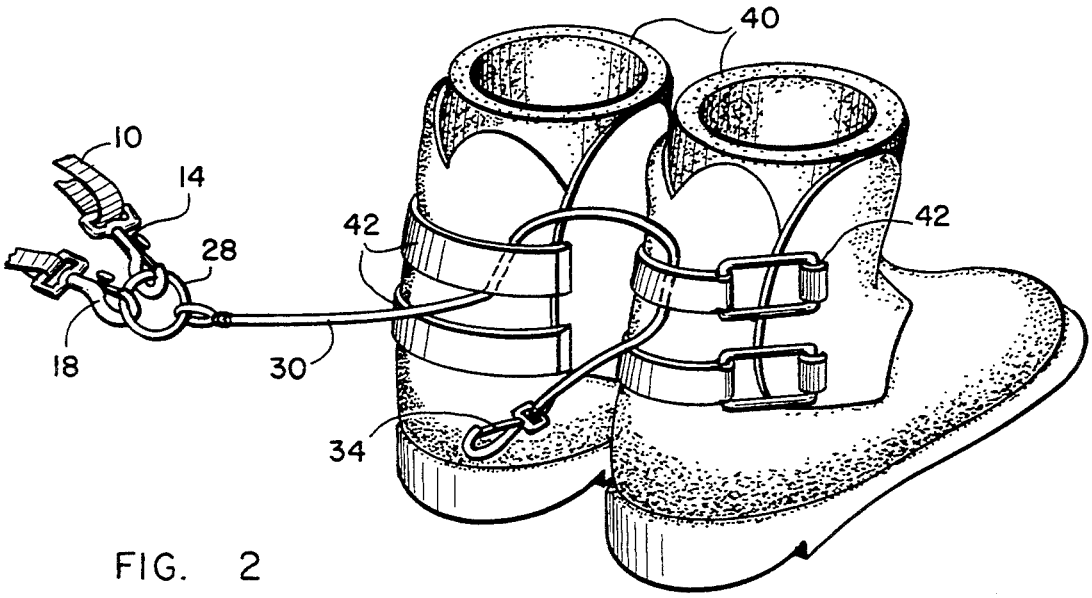
FIG. 2 is a perspective view of the strap and showing how the cord is attached to the boots to be carried.

As is best seen in FIG. 1, the invention consists of flexible strap 10 one end of which is affixed to the ring 12 of a snap fastener 14 with the other end of the strap 10 looped through the ring 16 of a second snap fastener 18 and then through a buckle 20 that allows the length of the strap between the fasteners 14 and 18 to be adjusted. Each of the snap fasteners 14 and 18 has a releasable clasp 22 that is secured to the respective one of the rings 12 and 16 by a swivel connector 24 which permits the clasp 22 to turn freely relative to the ring 12 or ring 16. Clasp 22 has a spring loaded arm 26 that can be pressed to open the clasp and allow it to be attached to or released from another object such as the circular ring 28.

Figure 3:
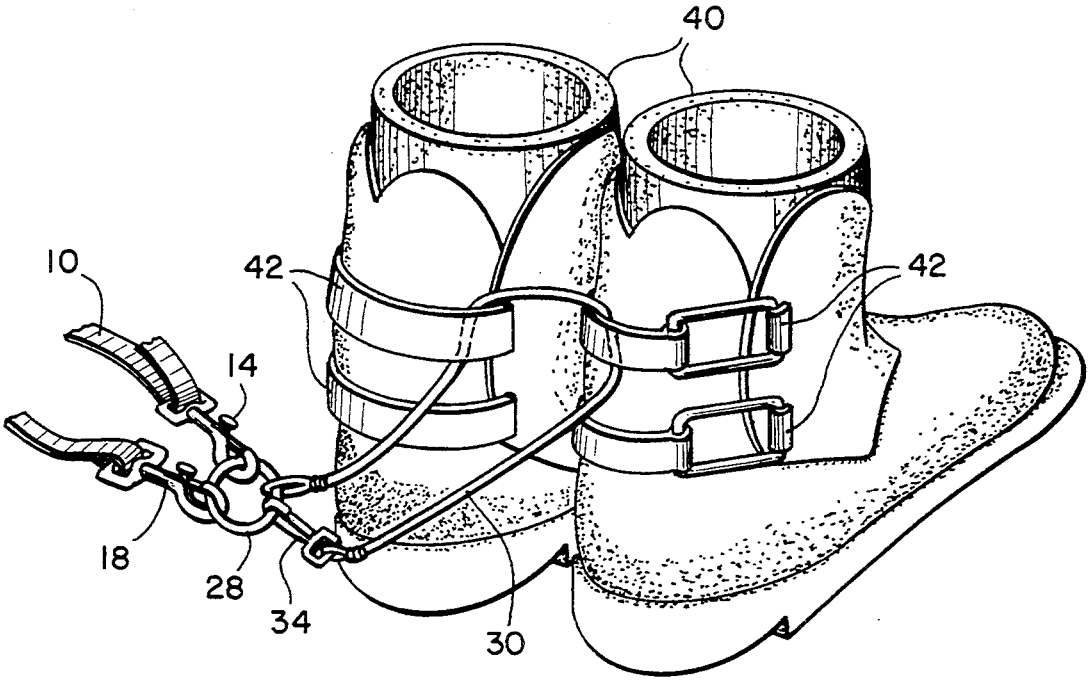
FIG. 3 is a perspective view of the strap after it has been attached to and coupled with the boots to be carried.
Figure 4:
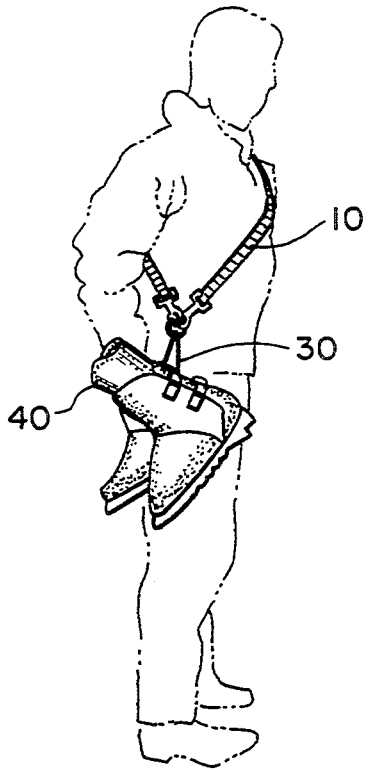
FIG. 4 is a view showing the strap and boots fitted over the shoulder of the user.

Also attached to the circular ring 28 is a cord 30 one end 29 of which is preferably permanently attached to the ring 28 while the other end of cord 30 is attached to the ring 32 of a snap fastener 34. Similar to the snap fasteners 14 and 18, fastener 34 has a clasp 36 that is affixed to the ring 32 through a swivel connector 38. The flexible strap 10 and cord 30 can be made of any suitable soft and flexible material such as cotton or cotton blends. The device of the invention is used to connect and carry a pair of boots such as ski boots 40. As is well known, each boot 40 has one or more buckles 42 that are permanently affixed to the boots 40 but when released, swing out away from the body of the boot 40. The end of cord 30 containing the snap fastener 34 can then be slipped behind the buckle 42 on one of the boots 40 and then behind the buckle 42 on the other boot 40. The buckles 42 can then be closed and the snap fastener 34 on the end of cord 30 is fastened to the circular ring 28 (see FIG. 3). This will then hold the two boots 40 securely together, and with use of the strap 10 the boots 40 can be carried by the user by placing the strap 10 over one shoulder and then across the chest and back so that the boots 40 rest about hip height on one side (see FIG. 4). If desired, after the cord 30 has been positioned between the buckle 42 of each of the boots 40, it can then be looped around itself to take up the slack and hold the boots 40 more tightly together. In either event, the use of the cord-strap arrangement provides a quick and easy way of coupling the two boots together and then allowing the user to carry them with both hands free to carry skis or other objects. When the user desires to put the boots on, it is a simple matter to release the snap fastener 34 from the ring 30 and pull the cord 30 free from the boots. The strap 10 and cord 30 together with their attached fasteners can then be rolled up and compactly and easily carried in by the user by placing it in a jacket or other pocket of the user's clothing.

From the foregoing description, it will be evident that I have provided a simple, inexpensive and easy to use device for connecting and carrying ski boots and other similar objects, such as roller or ice skates, roller blades, in-line skates, etc. By the use of an adjustable strap and swivel connectors on each of the snap fasteners, the device is not only easy to use, but it allows the user to position the coupled boots in the most comfortable position on the body with both hands free. The snap fasteners with their swivel connectors are commercially available items, and are available in metal or nylon. The material for the strap 10 and cord 30 are also commercially available materials, and the materials should be chosen for strength, durability, as well aesthetic appearance.

Having thus described the invention, it will be evident to those skilled in the art that various revisions and modifications can be made to the preferred embodiment described herein without departing from the spirit and scope of the invention. It is my intention however that all such revisions and modifications that are obvious to those skilled in the art will be included within the scope of the following claims.

What is claimed is as follows:

1. A device for connecting and carrying a pair of boots, said device comprising:

a strap having a length sufficient to extend over a shoulder of a user and across the user's body;

a ring affixed to the strap, which ring is positionable at a lowermost point of the strap when the strap extends over the user's shoulder;

a flexible cord attached at one end to the ring;

a releasable fastener attached to an opposite end of the cord to provide for attachment and detachment of said opposite end of the cord to the ring, the cord providing a means for connecting and holding the boots together;

swivel means for providing swivel movement of the cord and thus the boots relative to the strap to allow the boots to be easily and comfortably positioned when being carried by the user;

said strap having two free ends, and connecting means provided at each free end for connection of the strap to the ring; and, said connecting means including a swivel that allows the ring to swivel relative to the strap.

2. The device of claim 1 in which the strap is provided with means that allows the length of the strap to be adjusted.

3. The device of claim 1 in which the releasable fastener is also provided with a swivel that allows the cord to swivel relative to the ring.

* * * * *